United States Patent [19]

Machi et al.

[11] Patent Number: 4,660,340

[45] Date of Patent: Apr. 28, 1987

[54] GRAIN SILO

[75] Inventors: Fumiharu Machi, Ichikawa; Minoru Sawaide, Narashino, both of Japan

[73] Assignee: Shimizu Construction Co., Ltd., Japan

[21] Appl. No.: 741,444

[22] Filed: Jun. 5, 1985

[30] Foreign Application Priority Data

Jun. 9, 1984 [JP] Japan ..... 59-118592

[51] Int. Cl.[4] ..... E04B 1/32

[52] U.S. Cl. ..... 52/249; 52/309.12; 220/453; 220/85 B

[58] Field of Search ..... 52/309.12, 309.13, 309.17, 52/169.7, 506, 249, 245; 220/85 B, 453; 99/646 S

[56] References Cited

U.S. PATENT DOCUMENTS

| | | | |
|---|---|---|---|
| 2,653,118 | 9/1953 | Seymour | 52/309.17 X |
| 2,816,323 | 12/1957 | Munger | 52/309.17 X |
| 3,016,814 | 1/1962 | Beach | 99/646 S |
| 4,010,232 | 3/1977 | Labrecque | 52/309.12 |
| 4,135,443 | 1/1979 | Warren | 220/85 B X |
| 4,352,601 | 10/1982 | Valiga et al. | 52/169.7 X |
| 4,367,255 | 1/1983 | Blohm | 52/506 X |
| 4,480,411 | 11/1984 | Balz et al. | 220/453 X |

FOREIGN PATENT DOCUMENTS

| | | | |
|---|---|---|---|
| 753528 | of 1956 | United Kingdom | 52/309.17 |

OTHER PUBLICATIONS

"Concrete", John Delmonte, Concrete Sealed by Glass Cloth and Resin, Jun. 1949, pp. 12 and 45.

*Primary Examiner*—J. Karl Bell

*Attorney, Agent, or Firm*—Kane, Dalsimer, Kane, Sullivan and Kurucz

[57] ABSTRACT

A grain silo comprises a wall body having an inner wall surface and a lining coated on the inner wall surface. The lining comprises at least one protective layer which includes hydrophilic urethane resin of one-can type.

5 Claims, 3 Drawing Figures

GRAIN SILO

BACKGROUND OF THE INVENTION

1. Field of the Invention

This invention relates to a grain silo which is high in gas-tightness, liquid-tightness and durability and in which no charging phenomenon occurs in an inner wall surface of the silo.

2. Prior Art

As is well known, a silo has such various advantages that it is remarkably high in storage capacity, is reasonable in construction or structure, is easy in building, is easy in introduction and discharge of contents, and can prevent the contents from being changed in quality, as compared with a usual warehouse or storehouse. Therefore, the silo has been utilized as important, central facilities, for storing not only grain or cereals, but also industrial materials such as, for example, coal, sand, gravel, cement, ore, manure, common salt and the like.

In order to store the above-noted materials in a most effective manner, it is necessary that such silo has a wall thereof made of an air and moisture impermeable material and has a wall surface finished smoothly, to sufficiently insulate the material from the air. That is, it is required for the silo to secure high gas-tightness and liquid-tightness for a long period of time.

The construction or structure of the silo is broadly divided into three kinds, i.e., iron plate structure, iron plate/concrete structure and reinforced concrete structure.

Of the above three structures, both the iron plate structure and the iron plate/concrete structure exhibit satisfactory performance in gas-tightness and liquid-tightness, though the iron plate structure has such a disadvantage that it is lacking in ability of heat insulation. On the other hand, the reinforced concrete structure has such a problem that cracks are developed in the wall with the lapse of time which injure the gas tightness and liquid-tightness, though the reinforced concrete structure is manufactured at low cost and is superior in heat insulation. Heretofore, attempts have been made to resolve the problem by the provision of a wall surface protective layer or layers such as, for example, epoxy resin lining layers, fiber reinforced plastic (FRP) lining layer, an iron plate lining layer or the like, on an inner wall surface of an wall body of the silo of the reinforced concrete structure. The epoxy resin lining layers are formed by the successive coating and laminating of the whole or a part of a plurality of coating layers such as a primer or under coating, paste, resin mortar, main coating, finish or top coating and the like, each of which has blended therein epoxy resin.

However, the above-described conventional silo, i.e., the silo of such structure that the wall surface protective layer or layers such as multi-layer epoxy resin lining layers, FRP lining layers, iron plate lining layer or the like is or are provided on the inner wall surface of the silo wall body, has such disadvantage that the inner wall surface is liable to be or tends to be charged and there would be a risk of dust explosion in case where a material stored is a powder material such as wheat flour (for the epoxy resin lining layers and the FRP lining layers), the initial cost is high and there is no applicability to repair works of the existing silo of the reinforced concrete structure (for the iron plate lining layer), and the like.

SUMMARY OF THE INVENTION

An object of the present invention is to provide a grain silo which is high in gas-tightness and liquid-tightness, minimizes the injury of the gas-tightness and the liquid-tightness with the lapse of time, and prevents an inner wall surface from being charged.

According to the present invention, there is provided a grain silo comprising a wall body having an inner wall surface and a lining provided on the inner wall surface, the lining comprising a protective layer which includes hydrophilic urethane of one-can type.

With the present invention, the wall surface protective lining coated and formed on the inner wall surface of the silo wall body well follows the inner wall surface, the gas-tightness and the liquid-tightness would not be injured should cracks be developed in the wall body, and the wall surface protective lining is difficult to be charged so that there would be no fear of dust explosion even if a material stored is a powder material such as wheat flour, and a sufficient safety would be secured.

DESCRIPTION OF THE PREFERRED EMBODIMENT OF THE INVENTION

The present invention will be described in detail, by way of a mere example, with reference to the accompanying drawings.

Figure 1:
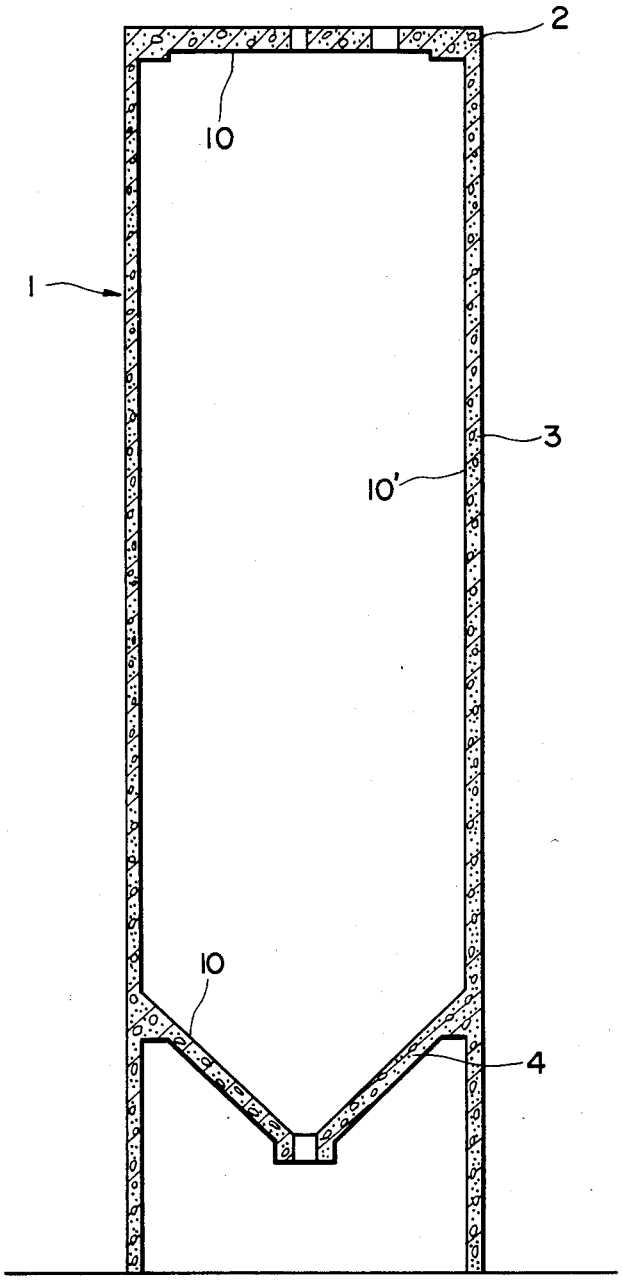
FIG. 1 is a vertical cross-sectional view showing a grain silo according to an embodiment of the present invention.

FIG. 1 of the drawings illustrates a grain silo according to an embodiment of the present invention which comprises a wall body, generally designated by the reference numeral 1. The wall body 1 is made of reinforced concrete in an integral manner and comprises a top wall 2, a tubular or cylindrical wall 3 and a bottom wall 4. The top wall 2 forms a lid portion having therein an opening through which a material to be stored is introduced into the silo 1, the cylindrical wall 3 forms an intermediate portion defining a storage space, and the bottom wall 4 forms a conical bottom portion having therein an opening through which the stored material is discharged out of the silo 1.

Figure 2:
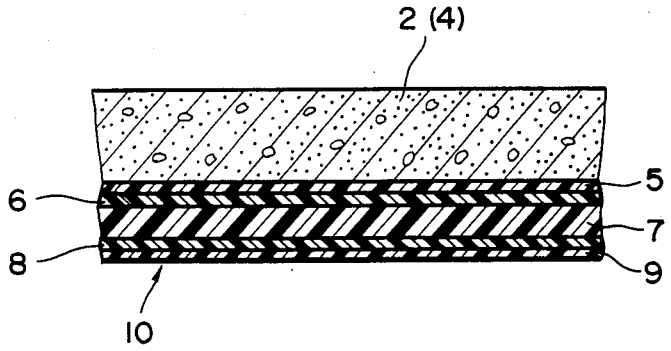
FIG. 2 is a fragmental cross-sectional view showing top and bottom walls of the silo shown in FIG. 1.
Figure 3:
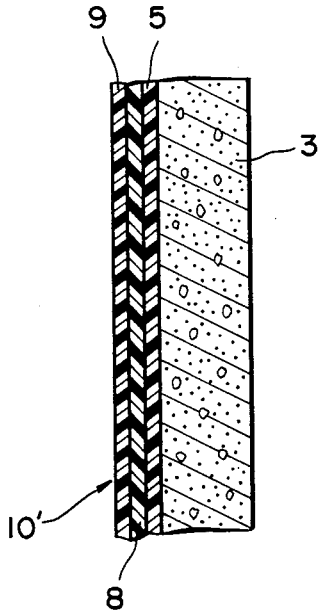
FIG. 3 is a fragmental cross-sectional view showing a cylindrical wall of the silo shown in FIG. 1.

Each of the top wall 2 and the bottom wall 4 has an inner wall surface thereof on which a wall surface protective lining 10 is provided so as to be capable of withstanding mechanical vibratory shock or impacts from the outside and violent contact with the grain or cereals. As shown in FIG. 2, the wall surface protective lining 10 is formed by a primer or under coating layer 5, a paste coating layer 6, a resin mortar coating layer 7, a main coating layer 8 and a finish or top coating layer 9 which are successively coated on the inner wall surface of each of the top and bottom walls 2 and 4.

On the other hand, an inner wall surface of the cylindrical wall 3 has provided thereon a wall surface protective lining 10' which is formed by the successive coating of only the primer coating layer 5, the main coating layer 8 and the finish coating layer 9, because the cylindrical wall 3 is soft or gentle in relation to the grain as compared with the top and bottom walls.

Each of the above-described wall surface protective linings 10 and 10', i.e., the primer coating layer 5, the paste coating layer 6, the resin mortar coating layer 7, the main coating layer 8 and the finish coating layer 9, has blended therein a predetermined amount of hydrophilic urethane resin of one-can type. In this one-can hydrophilic urethane resin, there is no residue of curing agent component (isocyanate system) which is apt to be called account when hydrophilic urethane resin of two-pack type is used. Accordingly, a problem regarding safety of the grain and the like may not be required to be taken into consideration. Furthermore, because of the one-can type, solvent is unnecessary and, therefore, it is possible to safely perform the works in a closed space within the silo and it is easy to prepare and handle the urethane resin. Moreover, because of the hydrophilic property, sufficient adhesive strength would be obtained, should an adhesive subject be contaminated with oil and be moisturized by rainwater. In addition, the cured layer has deformability and well follows the deformation of the adhesive subject, and has such a property as to be difficult to be charged.

Thus, each of the above-described wall surface protective lining is well adhered to the concrete substrate, well follows the cracks in the wall to maintain the gas-tightness and the liquid-tightness, and is not charged due to the frictional contact with the stored material. This eliminates a fear of dust explosion even if the stored material is a powder material such as wheat flour.

The illustrated embodiment is arranged such that the wall surface protective lining formed on the inner wall surface of each of the top wall 2 and the bottom wall 4 includes five (5) layers, and the wall surface protective lining formed on the inner wall surface of the cylindrical wall 3 includes three (3) layers. Such arrangement is adopted mainly based on the fact that more external force such as wear and the like due to the stored material is applied to the inner wall surface of each of the top wall 2 and the bottom wall 4, than that applied to the inner wall surface of the cylindrical wall 3. Accordingly, if desired, the wall surface protective lining on each of the top and bottom walls 2 and 4 and the wall surface protective lining on the cylindrical wall 3 may have the same construction as each other.

In addition, in the illustrated embodiment, although the hydrophilic urethane resin of one-can type is blended in all of the plurality of wall surface protective layers, the urethane resin may be blended only in the primer coating layer 5 and the finish coating layer 9, because only these two layers 5 and 9 have relation to the charging phenomenon and to the adhesion following the concrete, or, if desired, the urethane resin may be blended only in such main coating layer 8 as to achieve the adhesiveness and the charging prevention by the single layer 8.

As described above, since the grain silo according to the present invention is superior in adhesiveness of the protective lining, the silo is high in gas-tightness and the liquid-tightness and minimizes the injury of the gas-tightness and the liquid-tightness with the lapse of time. In addition, since the inner wall surface would not be charged, there would be no fear of dust explosion even in case where the stored material is a powder material such as wheat flour, and a sufficient safety would be secured.

What is claimed is:

1. A grain silo comprising:

a concrete shell having an inner face and defining a space for storing particulate material therein; and a means for preventing said inner face of said concrete shell from being charged due to friction of said inner face with material stored in said concrete shell, said preventing means comprising:

(a) an adhesive layer coated on said inner face of said concrete shell, said adhesive layer containing hydrophilic urethane resin of one-can type;

(b) a fluid-tight layer coated on the inner face of said adhesive layer; and (c) another layer coated on the inner face of said fluid-tight layer, said layer containing hydrophilic urethane resin of one-can type.

2. A grain silo according to claim 1, wherein the fluid-tight layer contains hydrophilic urethane resin of one-can type.

3. A grain silo according to claim 1, wherein said concrete shell comprises top, bottom and side walls, wherein said preventing means are provided on the inner face of each of said walls, and wherein the preventing means on the top and bottom walls further comprises a reinforcing layer interposed between said adhesive layer and said fluid-tight layer.

4. A grain silo according to claim 3, wherein said fluid-tight layer and said reinforcing layer contain hydrophilic urethane resin of one-can type.

5. A grain silo according to claims 1, 2, 3 or 4.

* * * * *